United States Patent [19]

Brynko et al.

[11] 4,089,547

[45] May 16, 1978

[54] MANIFOLD RECEPTOR SHEETS AND PROCESSES THEREFOR

[75] Inventors: Carl Brynko, Oakland; Stephen P. Grzech, Butler, both of N.J.

[73] Assignee: Reprographic Materials, Inc., Pompton Lakes, N.J.

[21] Appl. No.: 707,234

[22] Filed: Jul. 21, 1976

[51] Int. Cl.[2] ..... B41L 1/36; B41M 5/16

[52] U.S. Cl. ..... 282/27.5; 427/146; 427/150; 427/151; 427/261; 428/206; 428/211; 428/331; 428/336; 428/340; 428/342; 428/343; 428/447; 428/451; 428/452; 428/914

[58] Field of Search ..... 427/153, 261, 146, 150, 427/151; 282/27.5; 428/331, 452, 454, 914, 447, 391, 336, 342

[56] References Cited

U.S. PATENT DOCUMENTS

| | | | |
|---|---|---|---|
| 3,380,876 | 4/1968 | Rusher | 428/331 |
| 3,419,460 | 12/1968 | Ure | 428/331 X |
| 3,516,845 | 6/1970 | Brockett | 428/452 X |
| 3,617,410 | 11/1971 | Clark | 428/452 |
| 3,619,345 | 11/1971 | Kubo et al. | 428/331 X |
| 3,900,633 | 8/1975 | Piron | 282/27.5 X |
| 3,916,058 | 10/1975 | Vossor | 428/331 X |
| 3,931,428 | 1/1976 | Reick | 428/331 X |
| 3,993,500 | 11/1976 | Isaac et al. | 428/331 X |

*Primary Examiner*—Thomas J. Herbert, Jr.
*Attorney, Agent, or Firm*—Brooks, Haidt, Haffner & Delahunty

[57] ABSTRACT

Manifold receptor sheets for use with conventional donor sheets, the receptor sheet comprising a substrate having deposited thereon a coating comprising hydrophilic fumed silicon dioxide, together with processes for producing such receptor sheets.

9 Claims, No Drawings

MANIFOLD RECEPTOR SHEETS AND PROCESSES THEREFOR

BACKGROUND OF THE INVENTION

The present invention relates to receptor sheets for a manifold paper system, and more specifically, it relates to extremely lightweight receptor sheets which, when utilized with an appropriate donor manifold coating, will provide replicates upon the receptor sheet in a highly visible form with the same speed and having the same color intensity as conventional heavy weight sheets, together with processes for the preparation thereof.

Manifold paper systems have customarily been used in office and plant operations to simplify paperwork operations of billing, invoicing, shipping instructions, and the like. The information has been entered onto these systems by the impact of type or by the pressure of a pen or pencil on the surface. A problem common to all such operations is the pressure that must be applied to obtain the maximum number of legible copies, since the multiple thicknesses of paper used tend to spread out the applied force and thus reduce the pressure on lower sheets. If the manifold pack could be thinned, the pressure needed to produce legible copies could be reduced, or with the same pressure the number of copies could be increased.

Manifold paper systems ae well known, having been introduced into the market place many years ago. They operate through the agency of an oily ink having included therein initially colorless chromogenic reactants in cooperation with a receptor sheet sensitized with substantially insoluble acid-like materials of high surface activity. A typical example of the normally colorless chromogenic material included in the inks is crystal violet lactone and benzoyl leuco methylene blue, both of which, in colored form, have intense hues in the blue spectral band.

Generally, the oil solution of the chromogenic material is encapsulated and coated on a donor sheet, and the donor sheet and a specially coated receptor sheet are placed in physical contact. Upon application of pressure to the donor sheet, the capsules rupture and the oil solution is physically transferred to the receptor sheet whereupon a reaction between the coating on the receptor sheet and the chromogenic material occurs to produce a visible image upon the receptor sheet.

Receptor sheets have been coated with acid-like materials such as clays, resins and the like, and such materials have been predominantly clays with acid sites, such clays as attapulgite, kaolin, bentonite, and halloysite being utilized. Improvements in the clay coatings have been effected by incorporating resins, especially phenolic types, as shown in Brockett, U.S. Pat. No. 3,516,845. Other special coatings using high bulking resins and clays, as demonstrated in Clark, U.S. Pat. No. 3,617,410, have been used, but in all cases, high coating weights have been required.

THE INVENTION

The present invention overcomes the deficiencies of the prior art manifold sets by providing extremely light manifold receptor sheets. These receptor sheets, being thinner and lighter, provide more accurate and more legible replication of written symbols and permit the use of manifold sets which produce a greater number of copies.

Briefly, the superior results of the present invention are obtained by producing a manifold receptor sheet which utilizes a coating of fumed hydrophilic silicon dioxide particles adhered to at least a portion of one surface of a substrate. The novel manifold sheets according to this invention are prepared by blending fumed hydrophilic silicon dioxide particles with an appropriate adhesive material and depositing the particle-containing adhesive onto a substrate, as herein more fully described.

The active particles utilized herein to prepare the receptor sheet are constituted of the aforesaid material known as fumed hydrophilic silicon dioxide, hereinafter referred to as fumed silicon dioxide. This material has been found for purposes of the present invention to be unique in its action. Fumed silicon dioxide is prepared commercially by hydrolysis of silicon tetrachloride vapor in an oxygen-hydrogen flame and is available from the Cabot Corporation, Boston, Mass., under the name "Cab-O-Sil".

While the mechanism of the present invention may not be entirely explicated, fumed silicon dioxide has an extremely small particle size. While the size differs among the various grades of the fumed silicon dioxide, the formation of the silicon dioxide by the flame method produces particles which are generally spherical with diameters ranging from about 7 to about 14 nanometers (millimicrons). The fumed particles have a very high surface area and are of high purity.

The surface area is said to range from 200 $m^2/g$ for the 14 nm particles to about 400 $m^2/g$ for the 7 nm particles. The fumed silicon dioxide particles have an acid pH, which lies generally in the range of 3.5 to 4.2 in an aqueous mixture containing 4 percent of the fumed silicon dioxide.

The quantity of coating according to the present invention can be varied over a wide range. When referring to coated paper, the coating range is stated in terms of pounds per ream, a ream being 3300 $ft^2$ (500 25-inch by 38-inch sheets). It will be appreciated from the present disclosure that when substrates other than ordinary paper webs are provided, the coating will be sufficient to provide similar weights of the coating for 3300 $ft^2$. All parts, percentages, proportions, and ratios herein are by weight, unless otherwise stated.

The prior workers have generally found it necessary in preparing conventional manifold receiving sheets to provide coating weights of 4 to 5 lb/ream. An important advantage of the coatings and sheets according to the present invention is that coating weights of from about 0.3 to about 3.0 lb/ream can be used, and in preferred embodiments of the invention, the coating weight is from about 1 to 2 lb/ream.

The finished dry coatings according to this invention desirably contain from about 50 to about 95 percent of fumed silicon dioxide. In certain preferred embodiments, the coatings contain from about 85 to about 93 percent fumed silicon dioxide.

The substrates according the present invention are generally nonwoven webs. The substrate can be comprised of various fibrous materials including cellulosic materials such as sulfite paper, rag content paper, and the like, modified cellulosic materials such as rayon, acetate, and the like, polyolefins such as propylene and the like, peptides such as nylon, silk, and the like, fibers from other organic polymers and the like, and mixtures of two or more such materials. The surface or surfaces of the substrate sheet which are to be coated can be calendered or otherwise finished to alter, improve, or modify the surface or surfaces.

The active material, fumed silicon dioxide, is bonded to the substrate through the use of appropriate adhesives, such as vinyl compounds like polyacrylamides, polyacrylic acids, polyvinyl acetates, and the like, natural products such as casein, animal glues, and the like, polymer latexes, and similar materials. The adhesive is mixed with water, the active material added and coated onto the web. The adhesive is readily tailored to bond to non-paper web substrates when a receptor coating is desired on such substrates.

Accordingly, the processes of this invention comprise preparing a blend of fumed silicon dioxide in a vehicle containing an adhesive and then coating the blend onto at least one surface of the substrate. The quantity of fumed silicon dioxide and the quantity of adhesive in the vehicle are such that the final ratio of fumed silicon dioxide to adhesive will be sufficient to provide the above-disclosed amounts of fumed silicon dioxide on the substrate.

Generally, the blends contain from about 2 to about 15 percent of fumed silicon dioxide, and from 0.25 to about 5 percent of adhesive. The remainder of the blend is comprised of the vehicle.

The quantity of adhesive used is selected so as to be sufficient to adhere the fumed silicon dioxide particles to the selected substrate and to provide the necessary physical properties of the coating blend. The blend's physical properties of density, viscosity and other rheology, surface tension, and the like, will depend upon the type of product to be prepared and the manner of applying the blend to the substrate. Generally, in certain embodiments of the invention, it is preferred that the blend contain from about 4 to 10 percent of fumed silicon dioxide particles and from 0.4 to 1 percent of adhesive.

The vehicle selected will depend upon the physical factors mentioned above and the particular adhesives chosen. If the adhesive is soluble in organic solvents such as ketones, like acetone, ethers such as diethyl ether, "Cellosolve" polyoxyethylene glycols, and the like, aliphatic or aromatic bydrocarbons such as hexane, petroleum ether, naphtha, benzene, toluene, xylene, and the like, terpenes such as turpentine and the like, halogenated hydrocarbons such as carbon tetrachloride, perchloroethylene, dichlorotetrafluoroethane, and the like, or mixtures of such materials, these can be used. In certain embodiments of the invention, it has been found that an aqueous vehicle can be used, and this can be very desirable because of relatively low cost, lack of fumes and fire hazard, obviating recovery of the solvent, and other such advantages.

The adhesives used herein should adequately bind the fumed silicon dioxide particles to the substrate, should not cause discoloration of the substrate stock, should have a high degree of permanence and resistance to degradation by sunlight, ambient atmosphere, and the like. It is also desirable in certain embodiments that they be water-soluble. Accordingly, preferred adhesives for use herein include acrylics, such as polyacrylamide, polyacrylic acid, styrene-alkylacrylate copolymer, and the like, cellulose derivatives such as methyl cellulose, carboxymethyl cellulose, cellulose acetate phthalate, and the like, solubilized copolymers, such as ethylene-maleic anhydride copolymer, styrene-maleic anhydride copolymer, and the like, natural gums such as gum arabic, and the like.

The coatings used on the receptor sheets of the invention are applied to the substrate web by conventional paper coating techniques such as reverse roll, air knife, doctor blade, gravure roll coating, Meyer rod, and the like. The selection of technique used is dependent upon many factors, but an advantage of this invention is that the coater can use a method that will allow the coating to be applied at the highest web speed with an uniform layer. The materials of the present invention are applicable to all coating techniques.

The coating mixture to be applied to the web contains the fumed silicon dioxide suspended in water plus binders to adhere the materials to the web. After this slurry or dispersion is applied, the water or other vehicle of the dispersion is removed to produce a finished product. During this drying cycle, the thicker the coating applied, the longer the web must remain in a heated atmosphere, and during this heating of the web coupled with evaporation of the water, the web will undergo physical stresses in conjunction with the coating, causing cockling or deformation of the web and coating. In this invention, the coating is very light (or thin) on the web, so that rapid drying is allowed, and the tendency for deformation of the web is greatly reduced.

It will accordingly be understood from the description that the present invention provides novel methods for obtaining replicates, and methods comprising contacting chromogenic material-containing capsules with the fumed silicon dioxide coating on a substrate and applying a local force to rupture capsules and thereby release the chromogenic materials and permit them to contact the fumed silicon dioxide particles so as to form a colored symbol on the substrate. The encapsulated chromogenic materials are generally coated onto another sheet, but they can in certain embodiments be on the same substrate with the coating of this invention.

It will be appreciated by those skilled in the art from the present description that, while crystal violet lactone and benzoyl leuco methylene blue are particularly used to provide clear copies, other such materials reacting with an acid receptor can be used herein. Such equivalent leuco dyes which react with acid-like minerals in the manner of crystal violet lactone include malachite green lactone, rhodamine-B-lactam, o-hydroxybenzalacetophenone, and the like.

The following Examples are given to illustrate embodiments of the invention as it is presently preferred to practice it. It will be understood that these examples are illustrative, and the invention is not to be considered as restricted thereto except as indicated in the appended claims.

EXAMPLE I

A beaker equipped with an agitator is charged with 200 ml of water, 15 g of fumed silicon dioxide (Cab-O-Sil Type M-5), and 25 ml of a 5% polyacrylamide solution (supplied as PAM-25 by Alco Chemical Co., Philadelphia, Pa. Agitation is adjusted until a uniform blending of the silicon dioxide is obtained.

This coating material is applied to a paper web using a #22 Meyer Laboratory coating rod, and dried in an air stream at room temperature. The coating weight applied is 1.57 pounds per ream.

When this receptor sheet is tested with a donor sheet containing a colorless dye system in encapsulated form, and pressure is applied to the donor sheet with a writing implement a visible image appears at once.

EXAMPLE II

The procedure of Example I is repeated utilizing various Meyer rods to apply coatings to a paper web. The coating weights produced are shown in Table I.

TABLE I

| Meyer Rod Number | Coating weight (lb/ream) |
|---|---|
| 3 | 0.55 |
| 6 | 0.89 |
| 22 | 1.67 |
| 34 | 2.80 |
| 55 | 3.35 |
| 70 | 6.16 |

In each instance, use of the coated receptor sheet with a conventional donor sheet provides excellent images on the receptor sheet, and all of the images are of equal intensity, despite the differences in coating weights. It will be recognized that the last two samples shown in Table I are within the conventional range.

EXAMPLE III

A beaker equipped with an agitator is charged with 200 ml of water, 10 g of fumed silicon dioxide (Cab-O-Sil, Type M-5) and 15 ml of Acrysol ASE-60 (supplied as a 28% aqueous solution of a acid-containing cross-linked acrylic copolymer from Rohm & Haas, Philadelphia, Pa. Agitation is adjusted until a uniform dispersion is obtained.

This coating material is applied to a 20-pound weight white sulfite bond paper with a #22 Meyer coating rod, and dried in an air stream at room temperature. The coating weight applied is 1.46 pounds per ream.

When this receptor sheet is tested with a donor sheet containing a color forming system in encapsulated form, and pressure is applied to the donor sheet with a writing implement, a visible image appears.

EXAMPLE IV

The procedure of Example I is repeated utilizing 25 ml of a 2% carboxymethyl cellulose solution in lieu of the polyacrylamide.

A very good image is obtained when the receptor sheet is utilized with a conventional donor sheet.

EXAMPLE V

The procedure of Example I is repeated utilizing 25 ml of a 2% solution of methyl cellulose in lieu of the polyacrylic.

Use of the receptor sheet with a conventional donor sheet provides a very good image.

EXAMPLE VI

The procedure of Example III is repeated using 15 ml of a 25% polyacrylic acid solution (A-1, supplied by Rohm & Haas) in lieu of the acrylic copolymer. The results obtained are substantially the same as in Example III.

EXAMPLE VII

The procedure of Example III is repeated using 15 ml of a 25% solution of polyacrylic acid (A-3, supplied by Rohm & Haas) in lieu of the acrylic copolymer. The results obtained are substantially the same as those of Example III.

EXAMPLE VIII

The procedure of Example III is repeated using 15 ml of a 36% solution of a styrene-alkylacrylate copolymer (WS-24, supplied by Rohm & Haas) in liew of the acrylic copolymer. The results obtained are substantially the same as those of EXAMPLE III.

EXAMPLE IX

The procedure of Example III is repeated using 15 ml of a 5% ethylene-maleic anhydride copolymer solution (EMA-21, supplied by Monsanto Chemical Company, St. Louis, Mo.) in lieu of the acrylic copolymer. The results obtained are substantially the same as shown in Example III.

EXAMPLE X

The procedure of Example III is repeated using 15 ml of a 10% solution of cellulose acetate phthalate (supplied by Tennessee Eastman Corporation, Kingsport, Tenn.) in lieu of the acrylic copolymer. The results obtained are substantially the same as those shown in Example III.

It will be understood that the novel coatings of this invention can be placed on the "front" side, "back" side, or on the front and back sides of the substrate, front and back being referenced from the direction from which the force is applied to rupture the capsules and create the image. The novel coatings of this invention can be used in manifold sets which also include conventionally coated substrates on one side or a part of one side. The best results are of course obtained by utilizing the coatings and techniques of this invention exclusively.

The manifold sets prepared according to this invention can thus include sets which have the back side of the top sheet coated with capsules and the front of the next sheet coated with novel fumed coating material, and when a number of additional sheets are added, the back of the second sheet is coated with capsules to interact with the novel front coating of the third sheet, and so on. The novel coatings can be on the back of the sheet, with the coating according to this invention on the front of the succeeding sheet, or alternatively, the coating of this invention can be on the front of some sheets and the back of other sheets, with the capsules suitably disposed. The coating of the present invention can, as noted above, be combined with the capsules to form what are called "self-contained" sheets. These sheets do not need to contact any other treated sheet, and they are of course susceptible of forming additional images at a later time.

What is claimed is:

1. A manifold receptor sheet comprising a substrate coated on at least one surface with fumed hydrophilic silicon dioxide particles having an acid pH and a diameter ranging from about 7 to 14 nanometers and a surface area from about 200 $m^2/g$ to 400 $m^2/g$ and capable of reacting with a chromogenic material to produce a colored visible image, and an adhesive for maintaining the particles on the surface, the silicon dioxide particles comprising from 50 to 95 percent by weight of the coating.

2. A sheet according to claim 1 wherein substantially one entire surface of the substrate is coated.

3. A sheet according to claim 1 wherein the substrate is paper.

4. A sheet according to claim 1 wherein the adhesive is a polymer.

5. A sheet according to claim 1 wherein the weight of the coating is from 0.3 to about 3.0 pounds per ream.

6. A sheet according to claim 1 wherein rupturable capsules containing a chromogenic material are coated directly onto the coating of fumed silicon dioxide particles.

7. A process for preparing a sheet according to claim 1 wherein a solution of an adhesive having dispersed therein fumed silicon dioxide particles is coated onto a substrate.

8. A manifold set for replicating written symbols which set comprises a substrate coated on at least a portion of one surface with fumed silicon dioxide particles having an acid pH and a diameter ranging from 7 to 14 nanometers and a surface area of from about 200 $m^2/g$ to 400 $m^2/g$ and capable of reacting with a chromogenic material to produce a colored visible image and an adhesive for maintaining the particles on the surface of the substrate, and in contact with the coating a layer of pressure rupturable capsules containing a leuco dye-forming material, the silicon dioxide particles comprising from 50 to 95 percent by weight of the coating.

9. A set according to claim 8 wherein a plurality of substrates are in association so that the rupturable capsules on a first sheet are contiguous to the fumed silicon dioxide coating on a second sheet.

* * * * *